US005224850A

United States Patent [19]

Koh

[11] Patent Number: 5,224,850

[45] Date of Patent: Jul. 6, 1993

[54] ROTARY DEVICE WITH VANES COMPOSED OF VANE SEGMENTS

[76] Inventor: Koh, Pie S., Rm. 27, Cosmopolitan Centre, 4th Fl., 760, Nathan Road, Kowloon, Hong Kong

[21] Appl. No.: 766,654

[22] Filed: Sep. 26, 1991

[30] Foreign Application Priority Data

Sep. 28, 1990 [GB] United Kingdom ..... 9021194
Oct. 8, 1990 [GB] United Kingdom ..... 9021815

[51] Int. Cl.[5] ..... F01C 19/00

[52] U.S. Cl. ..... 418/111; 418/121; 418/148

[58] Field of Search ..... 418/111, 113, 120, 121, 418/148

[56] References Cited

U.S. PATENT DOCUMENTS

| | | | |
|---|---|---|---|
| 632,073 | 8/1899 | Toennes | 418/111 |
| 2,724,341 | 11/1955 | Bilas | 418/111 |
| 3,437,079 | 4/1969 | Odawara | 418/111 |
| 3,743,451 | 7/1973 | Chapman | 418/111 |
| 3,973,882 | 8/1976 | Winchell | 418/121 |
| 4,029,445 | 6/1977 | Mrlik | 418/120 |
| 4,317,648 | 3/1982 | Shimizu et al. | 418/120 |
| 4,548,560 | 10/1985 | Kanao | 418/148 |

FOREIGN PATENT DOCUMENTS

| | | | |
|---|---|---|---|
| 0152395 | 8/1985 | European Pat. Off. . | |
| 13927 | 12/1910 | France | 418/111 |
| WO84/03330 | 8/1984 | PCT Int'l Appl. . | |
| 427278 | 4/1935 | United Kingdom . | |
| 794773 | 5/1958 | United Kingdom . | |
| 960080 | 6/1964 | United Kingdom | 418/111 |
| 1137514 | 12/1968 | United Kingdom . | |
| 1293647 | 10/1972 | United Kingdom . | |
| 2099081 | 12/1982 | United Kingdom . | |
| 2218469 | 11/1989 | United Kingdom . | |

*Primary Examiner*—Richard A. Bertsch
*Assistant Examiner*—Charles G. Freay
*Attorney, Agent, or Firm*—Klarquist, Sparkman, Campbell, Leigh & Whinston

[57] ABSTRACT

A rotary engine comprises a rotor 14 rotating within an oval chamber 10 for rotation about an axis fixed with respect to the chamber. The rotor 14 has radial slots 19 receiving respective vanes 18 which are urged radially outwardly to make sealing engagement with the oval peripheral wall of the chamber 10. To ensure good sealing of the ends of each vane with respect to the end walls of the chamber 10, each vane 18 is of multi-part construction comprising end parts 50 for cooperation with the chamber end walls and an intermediate part 52. In one embodiment the intermediate part 52 and end parts 50 have cooperating inclined ramp faces such that an outwardly directed force applied to the part 52 by centrifugal force or by a biassing spring will cause the end parts 50 to be thrust laterally, by a wedging action, into sealing contact with the adjoining end walls. In a variant, the inclination of the cooperating ramp faces of the end parts and intermediate parts is reversed so that radially outwardly directed forces applied to the end parts 50 also cause the latter to be urged laterally outwardly. In a further variant, the end parts 50 and intermediate part 52 have mutually engaging forces which extend radially, but separately formed wedging members 66 are located in cavities in the central portion and act on the end parts 50 via lateral pins 84 to urge the end parts into sealing engagement with the end walls of the chamber 10.

6 Claims, 6 Drawing Sheets

ROTARY DEVICE WITH VANES COMPOSED OF VANE SEGMENTS

DESCRIPTION OF INVENTION

Figure 1:
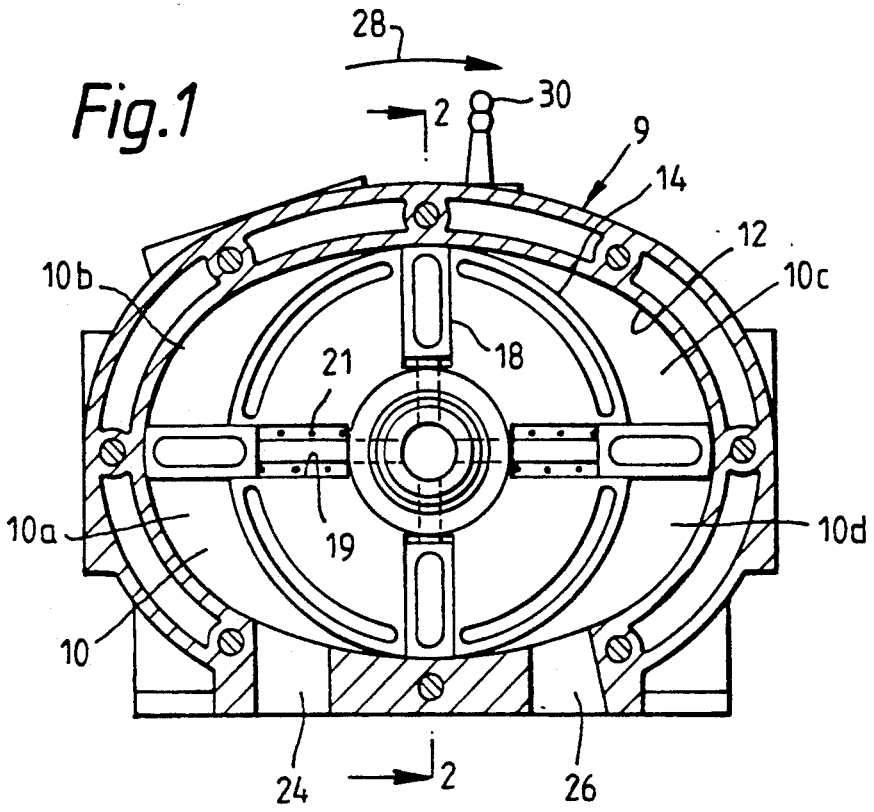

This invention relates to engines, pumps, compressors and the like machines of the type in which a rotor rotates within a cavity in a stator and carries sealing elements which sealingly engage the walls of said cavity to divide the space defined between the rotor and the stator into a plurality of working spaces which, where the machine is an internal combustion engine, form the combustion chambers, the volume of each said working space or combustion space varying cyclically with rotation of the rotor in the stator for compression, expansion or displacement of the working fluid.

Machines of the above-noted kind are herein referred to as "rotary engines".

Rotary engines of many kinds have been proposed, but these have all suffered from disadvantages of one kind or another, particularly from gas-sealing problems, and complexity of seal structure.

It is an object of the invention to provide a rotary engine, as herein defined, having improved sealing means for sealing the rotor with respect to the stator.

According to one aspect of the invention, there is provided a rotary engine, as herein defined, wherein said cavity comprises a peripheral wall extending around the rotor and opposing side walls between which the rotor is located and which connect with the peripheral wall at generally abrupt junction regions and wherein said rotor carries a plurality of sealing assemblies, each comprising at least two lateral parts mounted for independent displacement in the rotor, with at least a substantial radial component relative to the rotor axis, each said part including a portion engaging a respective said side wall of the said cavity and a portion supporting sealingly a further sealing element or blade cooperating with the peripheral wall of the said cavity, said parts having wedging surfaces inclined with respect to the axis of the rotor, the arrangement being such that, in operation, each of said parts of the sealing assembly is thrust against the respective side wall of the said cavity by the wedging action, applied to the respective wedging surface, of a component urged away from the rotor towards said peripheral wall.

Preferably each said sealing assembly comprises said two lateral parts engaging respective said side walls of said cavity and an intermediate part which has respective wedging surfaces cooperating with said wedging surfaces of said two lateral parts, said intermediate part being urged outwardly from the rotor to urge said two lateral parts in opposite directions against the respective side walls of the cavity.

According to another aspect of the invention, there is provided a rotary engine, as herein defined, wherein said cavity comprises a peripheral wall extending around the rotor and opposing side walls between which the rotor is located and which connect with the peripheral wall at generally abrupt junction regions and wherein said rotor carries a plurality of sealing assemblies, each comprising at least two lateral parts mounted for independent displacement in the rotor, in directions parallel with the rotor axis, each said part including a portion engaging a respective said side wall of the said cavity and a portion supporting sealingly a further sealing element blade cooperating with the peripheral wall of the said cavity and at least one wedging element having a wedging surface inclined with respect to the axis of the rotor, the arrangement being such that, in operation, the or each said wedging element is thrust away from the rotor axis towards said peripheral wall so that each of said lateral parts of the sealing assembly is thrust against the respective side wall of the said cavity by the wedging action.

Preferably each said sealing assembly comprises said two lateral parts engaging respective said side walls of said cavity and an intermediate part, guide means guiding said lateral parts for linear motion relative to said intermediate part, parallel with the rotor axis, and wherein the or each said wedging element is accommodated within an internal cavity in said intermediate part.

Figure 2:
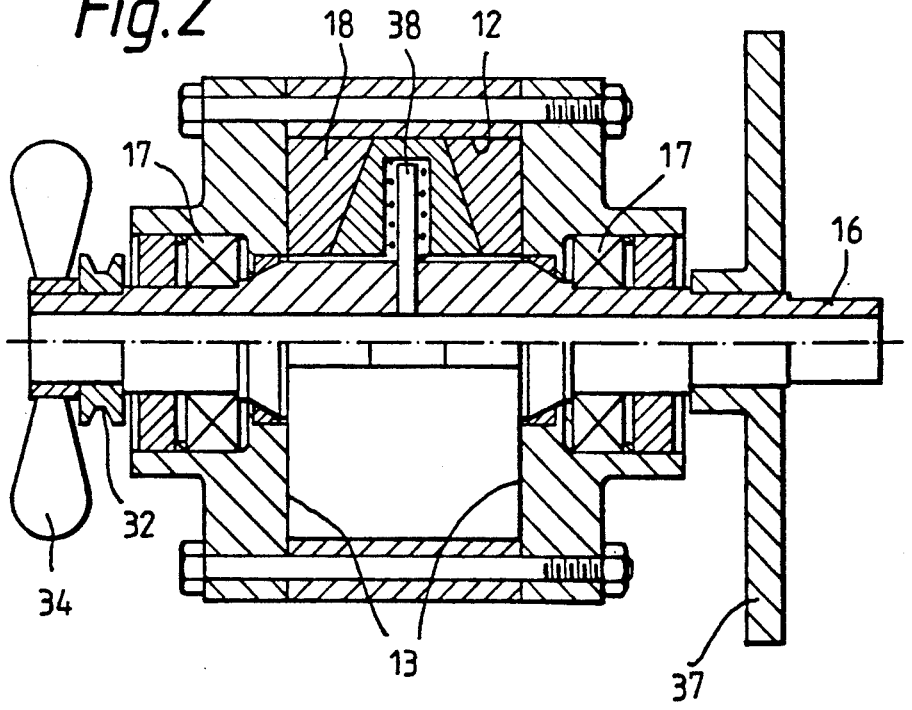
Figure 3:
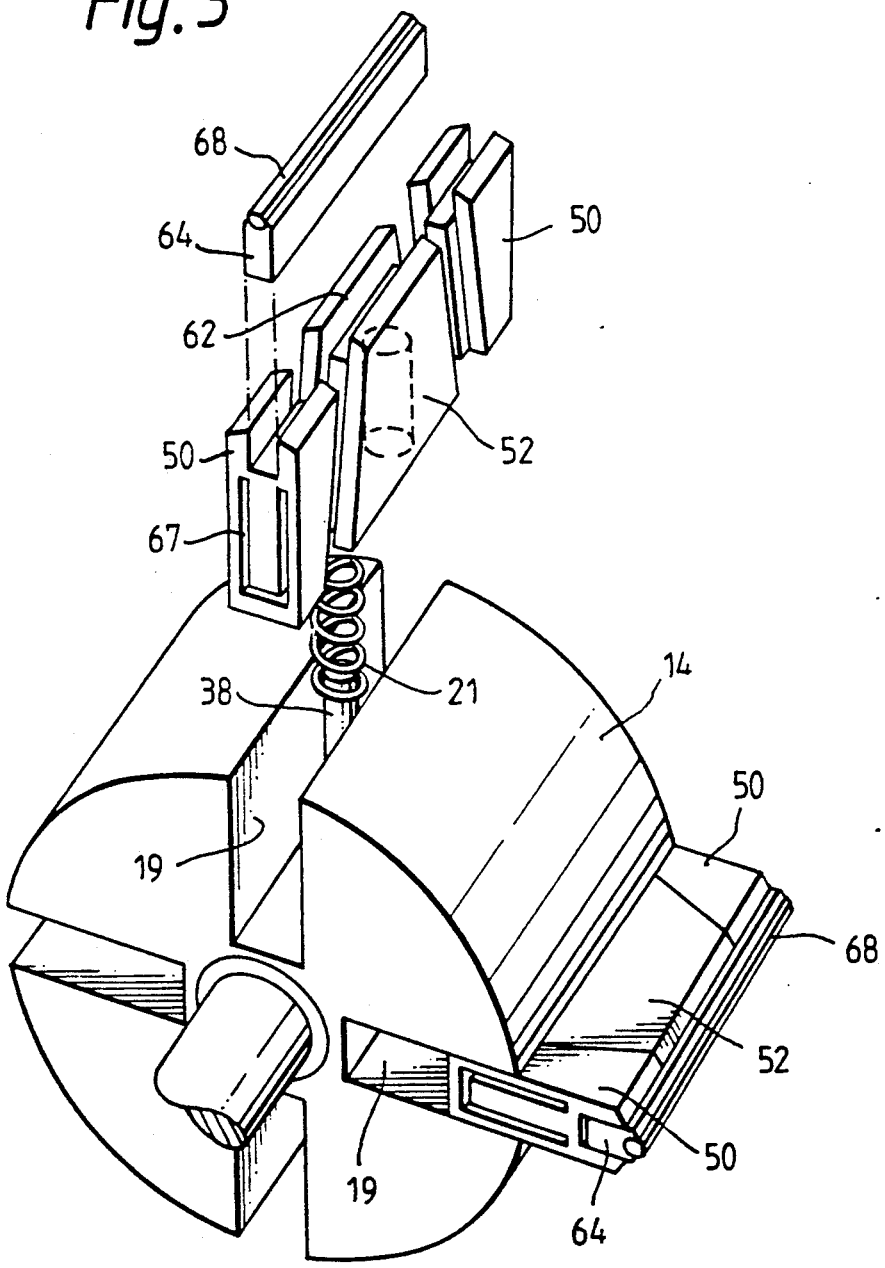
Figure 4:
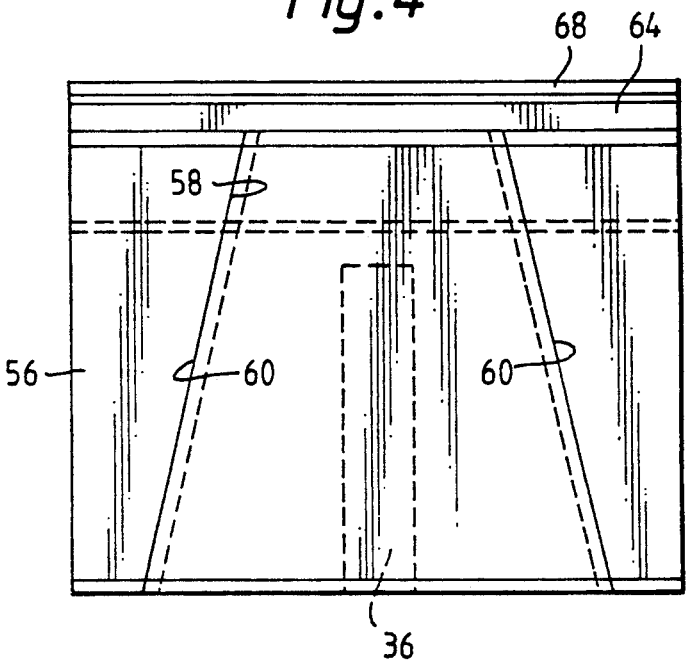
Figure 5:
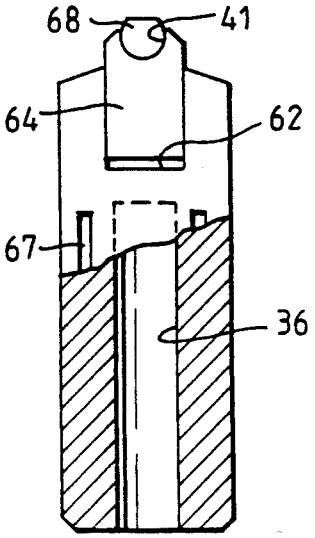
Figure 6:
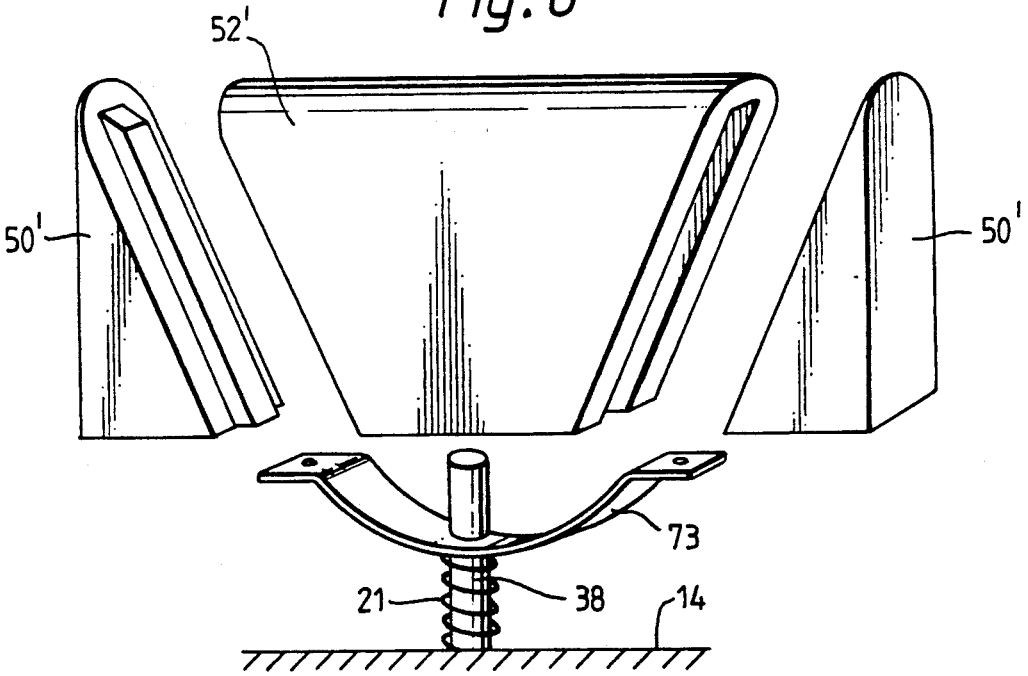
Figure 7:
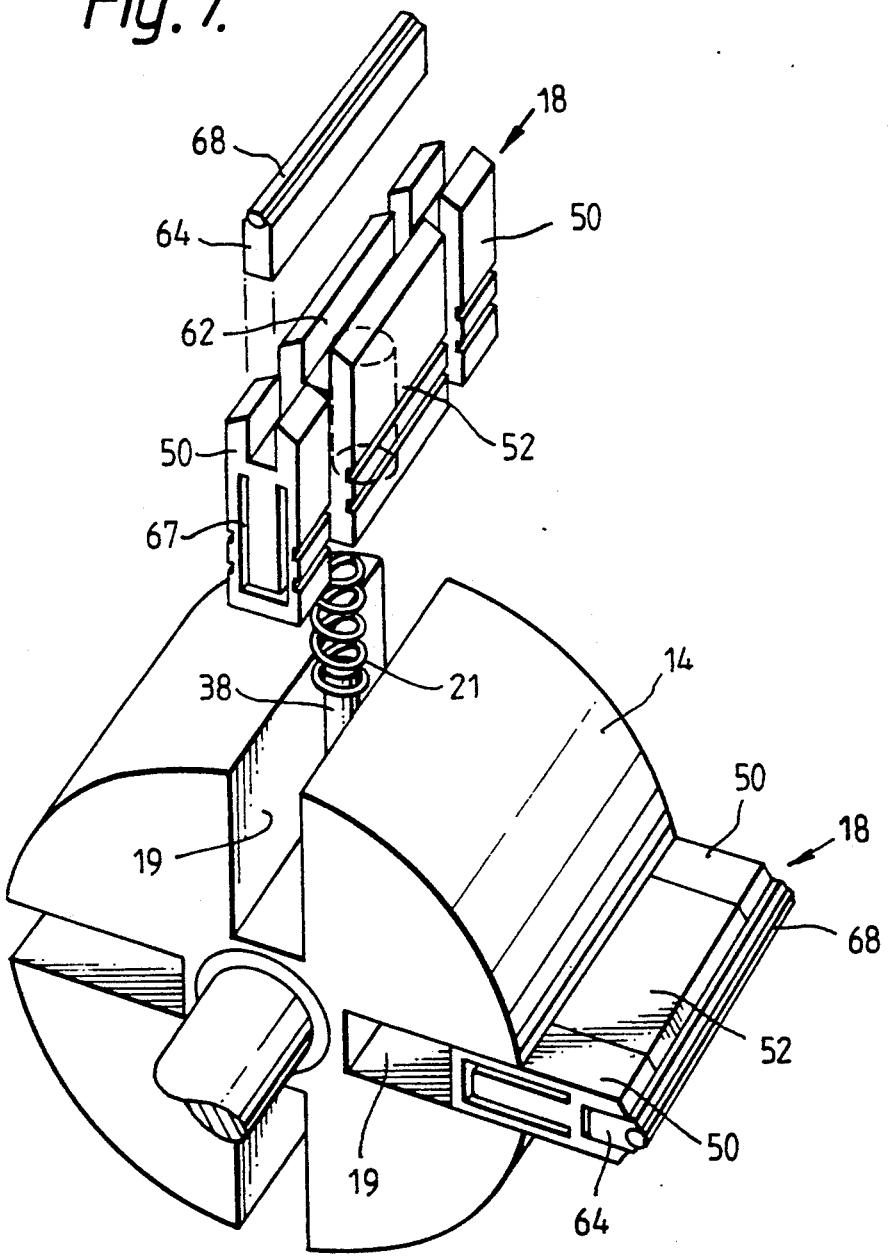

Embodiments of the invention are described below by way of example with reference to the accompanying drawings in which:

FIG. 1 is a schematic sectional view of one form of rotary engine embodying the invention, more particularly an internal combustion engine, FIG. 2 is a view in section along the line 2—2 in FIG. 1, FIG. 3 is an exploded perspective view showing the rotor and some of the seal assemblies of the engine of FIGS. 1 and 2, FIG. 4 is a front elevation view, and FIG. 5 is a side view, partly in section, of a seal assembly of the engine of FIGS. 1 to 3, FIG. 6 is an exploded perspective view illustrating an alternative form of seal assembly, FIG. 7 is an exploded perspective view similar to FIG. 3 but showing the rotor and some of the seal assemblies of a variant engine embodying the invention.

Figure 8:
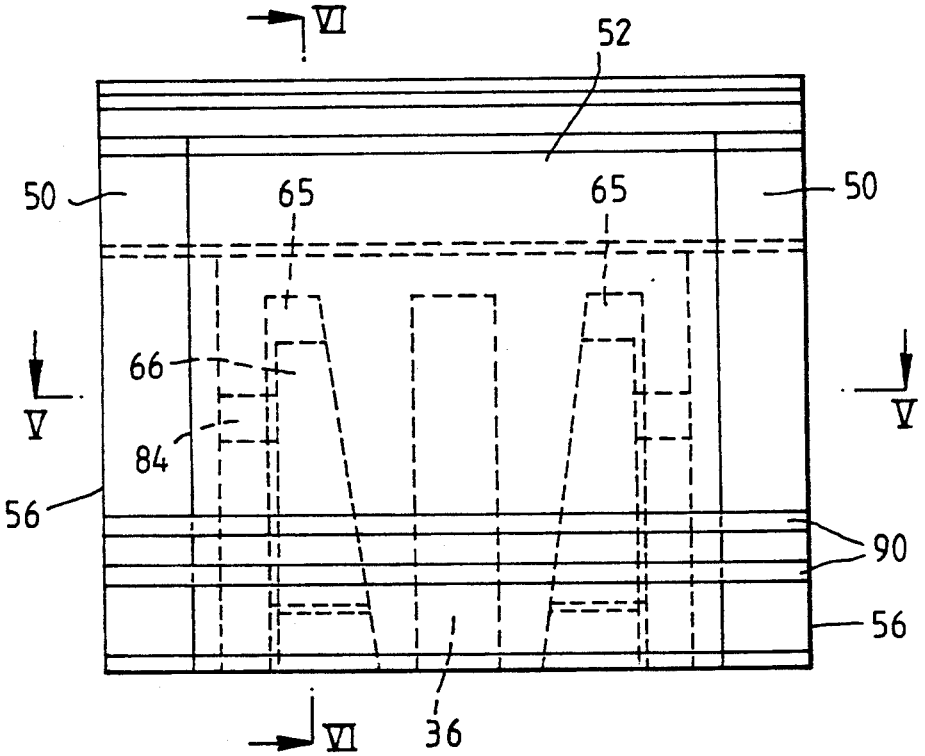
Figure 9:
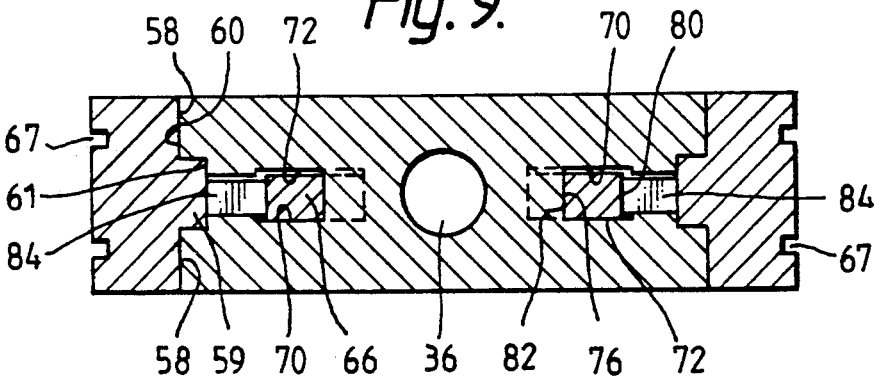
Figure 10:
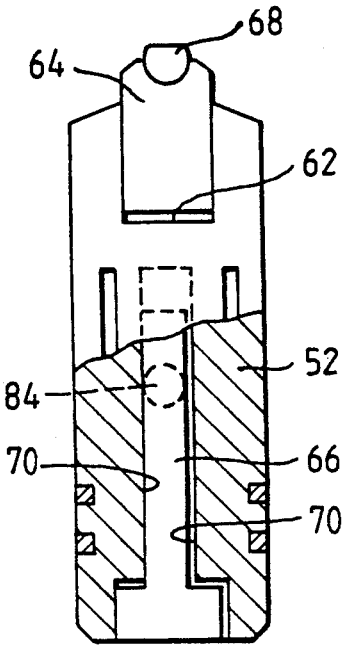
Figure 11:
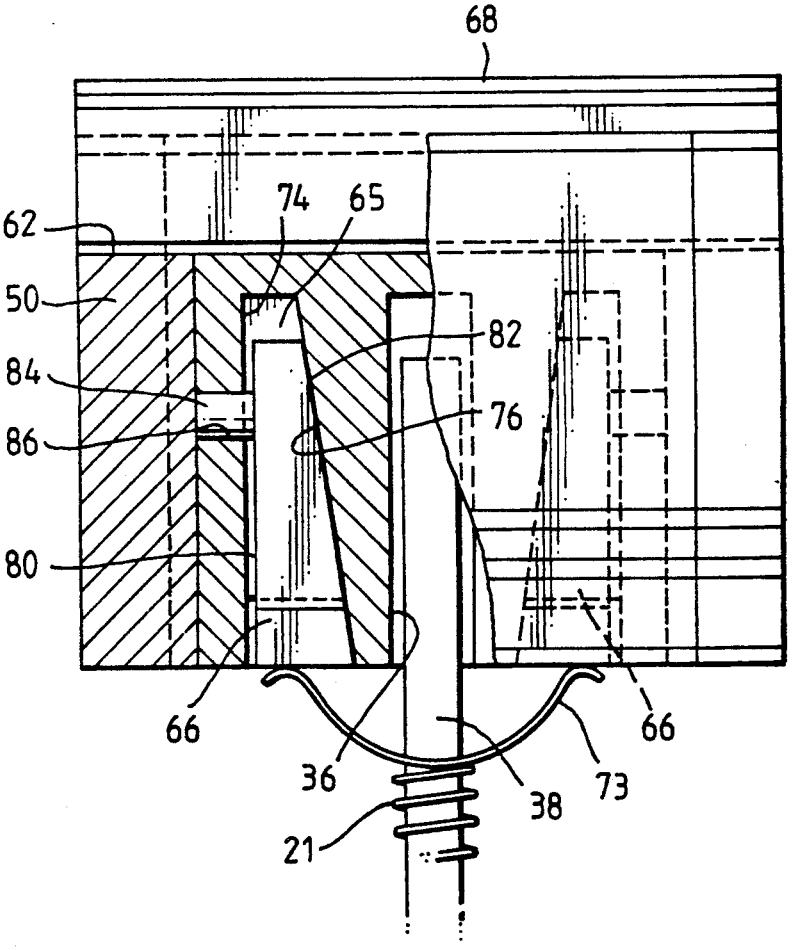

FIG. 8 is a front elevation view of a seal assembly of the engine of FIG. 7, FIG. 9 is a view in section of the seal assembly of FIG. 8, taken along the line V—V in FIG. 8, FIG. 10 is a view partly in end elevation and partly in section on the line VI—VI of FIG. 8, and FIG. 11 is a view similar to FIG. 8 but partly in section and illustrating biasing means for the wedging elements.

Referring to FIG. 1, a rotary internal combustion engine comprises a stator 9 affording an internal cavity or chamber 10 having a peripheral wall 12, which is elliptical as viewed in FIG. 1 and has opposing side walls 13 (FIG. 2) parallel with the plane of FIG. 1. Mounted within the chamber 10 is a rotor 14 fixed to or integral with a shaft 16 extending from the chamber 10, perpendicular to the side walls 13 and rotatably journalled in the stator by bearings indicated at 17. The rotor 14 is generally cylindrical, concentric with the shaft 16 and is a close fit between the side walls 13 of the chamber 10. The rotor 14 is mounted centrally within chamber 10, i.e. with its rotary axis passing through the point of intersection of the major and minor axes of the ellipse defined by wall 17. The rotor 14 has lateral faces which cooperate closely with the side walls 13. Mounted in the rotor 14 at 90° intervals therearound are vanes 18 which are accommodated within respective radial slots 19 in the rotor and project therefrom to engage the peripheral wall 12. Each slot 19 extends from one lateral face of the rotor to the other and each vane 18 extends from one side wall 13 to the other. Each vane 18 is reciprocable radially in its respective slot 19 and is biassed resiliently outwardly by spring means indicated schematically at 21 in FIGS. 1 and 2. It will be noted that the space defined between the rotor 14 and the peripheral wall 12 is thus divided, by the vanes 18, into four working chambers and that, as the rotor 14 rotates, the volume of each such working chamber alternately increases and decreases. In order to maximise the nominal compression ratio associated with these working chambers, the diameter of the rotor 14 is made only slightly smaller than the minor axis of the ellipse defining the peripheral wall 12.

An inlet port 24 and an exhaust port 26 are formed in the stator wall at spaced-apart locations therearound. In the position illustrated in FIG. 1, working spaces 10*a* and 10*d* are separated from each other by a vane 18 which is instantaneously engaged with a portion of the peripheral wall 12 between the inlet and exhaust ports 24, 26 and, given that the rotor is rotating in the direction indicated by the arrow 28 in FIG. 1, the chamber 10*a* is shown in the phase in which it is expanding to draw fuel/air mixture in through the inlet port 24, whilst the chamber 10*b* is shown in the phase in which it is being reduced in volume to compress a charge of fuel/air mixture therein, the chamber 10*c* is shown in the phase in which it is increasing in volume during expansion therein of hot combustion gases resulting from burning of a previously .compressed fuel/air charge, the charge having been ignited by means of a spark plug 30 having a spark gap exposed within the chamber 10*c* (the spark gap not being shown in the drawings). The chamber 10*d* is shown in FIG. 1 in the phase in which it is being reduced in volume to expel combustion products from the chamber 10*d* to the exhaust port 26. It will be appreciated that, at the particular instant in the working cycle illustrated in FIG. 1, the expansion of the combustion gases in chamber 10*c* is supplying work to the engine. The engine illustrated thus operates under a "four-stroke" cycle, with each space 10*a*, 10*b*, 10*c*, 10*d* cycling repeatedly through an intake phase, a compression phase, a combustion phase and an exhaust phase. Each chamber 10*a* to 10*d* has its largest volume when it is symmetrically disposed with respect to and bisected by the major axis of the ellipse defining the wall 12 and has its smallest volume when it is symmetrically disposed with respect to and bisected by the minor axis of said ellipse, a situation which, for the chambers 10*b* and 10*d* respectively, occurs after a further 45° rotation of the rotor from the position shown in FIG. 1. Preferably in the position after such further 45° rotation, the chamber 10*d* opposite that in which the spark plug 30 is exposed is in communication, temporarily, with both the inlet port 24 and the exhaust port 26, providing an appropriate degree of "overlap" between exhaust and intake phases. In FIG. 2, the reference 32 denotes a conventional pulley secured to the shaft 16 driving a water pump and generator (not shown) in known manner and the reference 34 indicates a fan secured to the shaft 16 to draw air through a cooling radiator (not shown). The reference 37 indicates a flywheel.

In FIGS. 3 to 5, in which parts corresponding to parts in FIGS. 1 and 2 have the same references, the form of a sealing vane 18 is shown in more detail than indicated in FIGS. 1 and 2. Each vane 18 is actually formed of a plurality of discrete parts and is herein also referred to as a sealing assembly.

As shown in FIGS. 3 and 7, each slot 19 in the rotor 40 extends from one side of the rotor to the other and is of uniform width, measured in the circumferential direction, i.e. perpendicular to the radius passing mid-way through the slot and perpendicular to the direction of the rotor axis, each slot 19 affording smooth flat parallel opposing side walls within which the respective sealing assembly 18 fits closely. Each sealing assembly 18 comprises three main body parts, preferably lightweight parts of aluminium alloy or the like, these parts comprising two lateral parts 50, located at axially opposite ends of the respective slot 19 and an intermediate part 52 which is located between the parts 50 and is sealingly engaged therewith. Each of the parts 50 52, occupies the full width of the slot 19 and each is of substantially the same dimension measured radially of the rotor. As illustrated in FIG. 4, in the assembled engine, the parts 50, 52, fit together, end to end, to form a composite generally rectangular block. Each lateral part 50 has a generally planar end face 56 substantially perpendicular to the direction in which the rotor axis extends and which end face 56 engages the opposing side wall of the stator cavity and has an opposite side face 58 which is inclined with respect to the face 56 and forms a ramp surface which mates with a correspondingly inclined surface 60 of the part 52. As illustrated, the faces 58, 60 may be provided with interengaging ribs and grooves, parallel with head ramp surfaces, to assist assembly of the parts 50, 52 and to restrain relative movement of said parts in the circumferential direction.

Extending along the radially outer end of the composite block formed by the parts 50, 52, is a rectangular-section groove or channel 62 which receives, as a close sealing fit, a generally rectangular-section seal support bar 64 which in turn supports a sealing bar 68: The support bar or blade 64 and the sealing bar 68 extend substantially from one end of the composite block formed by parts 50, 52 to the other and thus, in the assembled engine, closely adjoin the opposing side walls of the stator cavity. The support bar 64 is urged radially outwardly from the channel 62 by resilient biassing elements (not shown) mounted in the parts 50 and 52.

A bore 36 extends radially with respect to the rotor axis, into the part 52 from the radially inner end of part 52. Extending into the bore 36 from the central region of the rotor and fixed to the rotor is a radially extending tubular support 38. The helical compression spring 21 is located in bore 36 around support 38 and provides a radially outwardly directed bias force on the intermediate part 52. An axial oil-way through the shaft 16 communicates with an internal passage provided through the support 38 whereby lubricating oil can be supplied through oil-ways in the parts 52 and 50 to the channel 62, the cooperating faces of the parts 50 and 52, the walls of the slots 19 and so on.

Each sealing bar 68 is externally cylindrical, apart from a surface of substantially lesser curvature which engages the wall 12. The bar 68 is located within a part-cylindrical groove or channel 41 extending along the radially outer face of the support bar 64 parallel with the rotor axis, such channel receiving, as a close rotating fit, the correspondingly cylindrical part of the surface of the bar 68. This arrangement allows the bar 68 to pivot about the axis of curvature of its cylindrical surface, relative to the bar 64, as the latter travels around the wall 12 during rotation of the rotor. The curvature of the surface of lesser curvature of the bar 68 is intermediate the maximum and minimum curvature of the wall 12, so as to fit as closely as possible with the wall 12. Each end part 50 has, in its end face 56, slots 67, for example, of "U"-shape, with legs extending radially with respect to the rotor axis, which receive correspondingly shaped sealing bars (not shown) backed by appropriate biassing springs, (not shown) which seal the laterally outer ends of the parts 50 relative to the side walls 13. The parts 50, 52 may be sealed with respect to the walls of the slots 19 in the rotor simply by being made an accurate sliding fit therein or (not shown) by sealing elements carried by the rotor in the walls of the slots 19. The lateral faces of the rotor 14 may also be sealed with respect to the side walls 13 by means of an arrangement of annular sealing rings, for example accommodated in annular grooves in the side walls 13.

The spring 21 acting on the intermediate part 52 urges the latter radially outwardly from the rotor so that, by the wedging action of the cooperating faces 50, 52, of the parts 52 and 50, the parts 52 are urged simultaneously radially and laterally outwardly, thereby ensuring that the lateral faces 56 of the parts 52 sealingly engage the side walls 13 of the stator cavity. The depth of the channel 62 radially and the radial distance over which the biassing elements (not shown) acting between the parts 50, 52 and the bar 64 are effective, are such that the slight relative radial movement of the parts 50 and 52 consequent upon this wedging action can readily be tolerated. When the engine is running at a normal operating speed, of course, the centrifugal force acting on the members 50, 52, is sufficient to maintain the parts in the outermost positions in which they urge the sealing bar 68 via the bar 64 against the peripheral wall 12 of the stator cavity. Centrifugal force acting on the intermediate part is likewise sufficient, at normal running speeds, to produce the desired wedging action referred to above. The spring 21 merely serves to urge the parts 50, 52, radially outwardly and to produce the necessary wedging action, when the engine is stationary or rotating at low speed (e.g. during starting).

FIG. 6, illustrates a variant form of sealing assembly, in which the inclinations of the mating faces of the laterally outer parts 50' and the intermediate part 52' are reversed and in which a biasing spring 21', corresponding with the spring 21 in the previous embodiment, acts, via a yoke, illustrated schematically at 73, on the radially inner surfaces of parts 50' to urge the latter radially outwardly with respect to the intermediate part 52' (the latter being restrained by engagement, via the sealing bar 68 and sealing support bar 64 (not shown in FIG. 6) with the peripheral wall 12), the consequent wedging action between the inclined mating surfaces of the parts 50' and 62' serving also to urge the parts 50' outwardly into firm sealing engagement with the side walls 13 of the stator cavity.

In the variant illustrated with reference to FIGS. 7 to 11, in which like parts have the same references as in FIGS. 1 to 6, each lateral part 50 has opposite its end face 56, a surface which cooperates with an opposing end surface of the part 52. As shown in FIG. 9, said opposite surface of each lateral part 50 may comprise co-planar outer faces 58 extending parallel with the end face 56 and a central tongue 59 projecting from the plane of said co-planar outer faces towards and into the parts 52, said tongue 59 extending longitudinally along a radius from the rotor axis and having flanks parallel with the sides of the respective slot 19. The cooperating outer surface of the part 50 is of complementary form, affording co-planar outer faces 60 parallel with or mating with the opposing outer faces 58 and a central groove or channel 61 which receives the tongue 59 as a close sliding fit.

The part 50 has two internal cavities 65 extending radially outwardly from the radially inner face of the part 52 and accommodating respective wedge elements 66 for radial movement therein, the cavities 65 having internal lateral walls 70 parallel with the sides of the respective slot 19 and slidably engaging the opposing parallel side faces 72 of the respective wedging element 66. Each cavity 65 terminates at its side nearer to the adjacent part 50 in a side wall 74 extending radially with respect to the rotor axis and perpendicularly to said lateral wall 70 and each cavity terminates, at its side further from the adjacent part 50, in a side wall 76 which is perpendicular to the lateral walls 70 but is inclined with respect to the side wall 74 so that the cavity 65 narrows from its radially inner end to its radially outer end. Each wedging element 66 likewise has a side face 80 which opposes and is parallel with the respective side wall 74 and has a face 82 which is inclined with respect to the face 80 and mates with and is slidable on the inclined side face 76 of the cavity.

Each part 52 has a peg 84 projecting from its rib 59 parallel to the rotor axis and extending through an aligned bore 86 in the part 50 into the adjacent cavity 65, the free end of the peg 84 in the assembled engine engaging the face 80 of the element 66.

In the variant of FIGS. 7 to 11, the respective bore 36 receives the respective support 38 but not the respective spring 21 located around the support 38.

Instead, as shown in FIG. 11, the biasing spring 21 fitted around the support 38 acts, via a yoke, illustrated schematically at 73, on the radially inner surfaces of wedging elements 66 to urge the latter radially outwardly with respect to the intermediate parts 52, 50 (the latter being restrained by engagement, via the sealing bar 68 and sealing support bar 64, with the peripheral wall 12), the consequent wedging action between the inclined mating surfaces 82, 76 of the wedge elements 66 and the cavities 65, respectively, on the one hand, and between the surfaces 80 of the wedge elements 66 and the free ends of pegs 84, on the other hand, serving to urge the parts 50 outwardly from the part 52 into firm sealing engagement with the side walls 13 of the stator cavity.

The spring 21 acting on the wedge elements 66 indirectly urges the intermediate part 52, and thus, by the pegs 84, the parts 50 radially outwardly from the rotor to urge the sealing bar 64, 68 against the peripheral wall 12. When the engine is running at a normal operating speed, of course, the centrifugal force acting on the members 50, 52, is sufficient to maintain these parts in the outermost positions in which they urge the sealing bar 68 via the bar 64 against the peripheral wall 12 of the stator cavity. Centrifugal force acting on the wedge elements 66 is likewise sufficient, at normal running speeds, to produce the desired wedging action referred to above. The spring 21 merely serves to urge the elements 66 and thus the parts 50, 52, radially outwardly and to produce the necessary wedging action, when the engine is stationary or rotating at low speed (e.g. during starting).

The lateral faces of the parts 50, 52 of each vane are sealed with respect to the opposing side walls of the respective slots 19 by further sealing bars, indicated at 90 in FIG. 8 but not shown in FIG. 7, accommodated in longitudinal grooves, parallel with the rotor axis, in said lateral faces of the parts 50 and 52. Thus, each straight lateral sealing bar 90 has its major portion, intermediate its ends, accommodated within a rectangular-section groove in the lateral face of the intermediate part 52 and has its end portions accommodated in respective grooves formed in the respective lateral parts 52, the last-mentioned grooves being of the same cross section as and formed as extensions of the corresponding groove in the lateral face of part 50. Spring biasing arrangements, known per se and not shown, act to urge the lateral sealing bars against the opposing side walls of the slots 19. It will be appreciated that movement of the lateral portion 50 away from the intermediate portion and towards the respective side walls of the stator cavity is not interfered with by the sealing bars 90 since the end portions of the latter merely move longitudinally in the respective grooves in the parts 50, whilst radial movement of the parts 50 relative to the parts 52 is prevented by the pegs 84 so that there is no risk of breakage of the sealing bars 90.

It will be appreciated that various modifications are possible. Thus, for example, it would be possible for a single wedging element to be provided within the intermediate part 52, the single wedging element having opposite wedging faces engaging the ends of the pegs 84, the support 38 being replaced by some other guiding and lubricating arrangement. In another possible arrangement, the cavities accommodating the wedging element 66 may open into and be continuous with the grooves 61 receiving the tongues 59 of the lateral parts 50, with the outer faces of the wedging elements 66 directly engaging the opposing end surfaces of the tongues 59, with locating pegs or other locating formations, fulfilling the locating functions of the pegs 80, being provided at locations compatible with such modified arrangements.

I claim:

1. A rotary machine comprising:

a stator defining a cavity, a rotor rotatable within the cavity on a rotary axis, said cavity comprising a peripheral wall extending around the rotor and opposing side walls between which the rotor is located and which connect with the peripheral wall at generally abrupt junction regions, the peripheral wall defining with the rotor a peripheral space, said rotor having a plurality of slots defined therein, each slot extending between the opposite ends of said rotor and to the peripheral surface of the rotor, a respective sealing assembly in each said slot, each said sealing assembly being mounted for sliding movement in its respective said slot toward and away from said peripheral wall of said cavity, each said sealing assembly, in operation of the machine, sealingly engaging the peripheral wall, and said side walls of said cavity, to divide the space defined between the rotor and the peripheral wall of the stator into a plurality of working spaces, the distance of said peripheral wall of the chamber from said peripheral surface of the cavity varying around the circumference of the stator whereby the volume of each said working space varies cyclically with rotation of the rotor in the stator, each said sealing assembly including:

an intermediate part, two lateral parts on either side of said intermediate part whereby each said lateral part is interposed between said intermediate part and a said side wall of the cavity, first guiding means for guiding each said lateral part for translational movement with respect to the associated intermediate part in a respective direction parallel to the respective slot and parallel to the rotary axis of the rotor, toward and away from the respective said cavity side wall, second guiding means for guiding each said intermediate part for translational movement in a direction perpendicular to the rotary axis of said rotor, and each said sealing assembly including wedging means movable relative to said lateral parts and intermediate part, toward and away from said peripheral wall of the cavity, said wedging means being arranged to act between said intermediate part and the associated said lateral parts for urging the lateral parts outwardly from said intermediate part into engagement with the adjacent said side walls of the cavity.

2. A rotary engine according to claim 1 wherein each of said sealing assembly defines a slot extending longitudinally along the radially outer edges of each said intermediate part and of each of said lateral parts, and wherein each said sealing assembly includes a blade cooperating with the peripheral wall of said cavity and received within said slot.

3. A rotary engine according to claim 1 including biasing means for urging said wedging means to radially bias said intermediate part and for urging apart said lateral parts of each said sealing assembly.

4. A rotary engine according to claim 1 wherein said wedging means in each said sealing assembly comprises two wedging elements, each intermediate part of each sealing assembly having two cavities extending radially therein from a radially inner end of the intermediate part, each said wedging element having two mutually inclined lateral surfaces, whereby each wedging element tapers in width radially outwardly from the rotor axis, such width being measured parallel with the rotor axis, each said cavity having a lateral surface in mating sliding engagement with one of said two lateral surfaces of the wedging element accommodated therein, the respective said lateral part having a portion with a surface in mating sliding engagement with the other of said two lateral surfaces of the wedging element.

5. A rotary engine according to claim 4 wherein each of said cavities in each said intermediate part is open on the radially innermost surface of the intermediate part and wherein resilient biasing means is provided having two engagement portions, each engaging the radially inner end of a respective said wedging element, exposed at the radially inner end of the respective said cavity, said biasing means acting for urging said wedging elements radially outwardly with respect to the rotor and thus acting indirectly to urge the associated intermediate and lateral parts of the respective sealing assembly radially outwardly also, while simultaneously urging said lateral parts away from the intermediate part against the side walls of said cavity.

6. A rotary engine according to claim 1 wherein each said sealing assembly includes sealing bars which seal the circumferentially facing major faces of the assembly with respect to the cooperating faces of the respective rotor slot, each said sealing assembly defining a respective longitudinal groove extending across each of said major faces, provided by the respective intermediate part and lateral parts in combination, the grooves extending parallel with the rotor axis, receiving a respective said sealing bar extending over substantially the whole length of the respective lateral slot, and wherein means is provided preventing radial movement, relative to the rotor axis, of said lateral parts with respect to the associated intermediate parts, such as might break said sealing bars.

* * * * *